US008541953B2

(12) United States Patent
Hwang et al.

(10) Patent No.: US 8,541,953 B2
(45) Date of Patent: Sep. 24, 2013

(54) LED DRIVING DEVICE

(75) Inventors: Bo Hyun Hwang, Gyeonggi-do (KR); Jung Sun Kwon, Gyeonggi-do (KR); Jung Hyun Kim, Gyeonggi-do (KR); Seung Kon Kong, Gyeonggi-do (KR); Jae Shin Lee, Gyeonggi-do (KR); Joon Youp Sung, Gyeonggi-do (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 309 days.

(21) Appl. No.: 13/109,535

(22) Filed: May 17, 2011

(65) Prior Publication Data

US 2012/0212146 A1 Aug. 23, 2012

(30) Foreign Application Priority Data

Feb. 21, 2011 (KR) ..... 10-2011-0015106

(51) Int. Cl.
*H05B 37/02* (2006.01)

(52) U.S. Cl.
USPC ..... 315/210; 315/291; 315/209 R

(58) Field of Classification Search
None
See application file for complete search history.

(56) References Cited

FOREIGN PATENT DOCUMENTS

KR 10-2010-0050908 5/2010

*Primary Examiner* — Crystal L Hammond
(74) *Attorney, Agent, or Firm* — McDermott Will & Emery LLP

(57) ABSTRACT

Disclosed herein is a light emitting diode (LED) driving device for driving a multi-channel LED element or an LED array for each channel, the LED driving device including: a constant current driver driving currents flowing in each channel; a first switching unit selectively feeding-back voltage levels of each channel; and a switching controller controlling the turn on/off of the first switching unit, wherein matching characteristics of currents flowing in each channel is improved and a size of an integrated circuit (IC) chip is also reduced as compared to a case according to the related art, thereby making it possible to reduce a production cost and satisfy the trend of miniaturization of the chip, while solving a performance deterioration problem due to degradation of the matching of the currents between the channels.

11 Claims, 4 Drawing Sheets

- PRIOR ART -

LED DRIVING DEVICE

CROSS REFERENCE(S) TO RELATED APPLICATIONS

This application claims the benefit under 35 U.S.C. Section 119 of Korean Patent Application Serial No. 10-2011-0015106, entitled "LED Driving Device" filed on Feb. 21, 2011, which is hereby incorporated by reference in its entirety into this application.

BACKGROUND OF THE INVENTION

1. Technical Field

The present invention relates to a light emitting diode (LED) driving device, and more particularly, to an LED driving device capable of having a compact size, while solving a problem that a degree of scattering of a current increases due to the use of a plurality of amplifiers in driving the LED in a multi-channel driving scheme.

2. Description of the Related Art

A light emitting diode (LED) has been widely used in various fields such as illumination, a backlight unit (BLU), or the like. Recently, as a market of the LED has quickly expanded, the related technology has been rapidly advanced.

Generally, an LED current is mainly set and controlled by conversion dimming signal (ADIM) and resistor (RLED) parameters.

Meanwhile, in a light emitting diode back light unit (LED BLU), a multi-channel driving scheme has been used in order to use partial dimming and scanning functions. At the same time, a linear scheme has been used in order to maintain the same brightness.

The linear scheme is advantageous in terms of a cost. However, in this scheme, in order to constantly maintain currents of LED channels, amplifiers have been respectively used for each channel. Each of the amplifiers indicates unique offset voltage characteristics, such that a degree of scattering of currents between each channel increases, thereby reducing matching characteristics between the channels.

FIG. 1 shows a linear constant current driving scheme of a general multi-channel LED according to the related art.

As shown in FIG. 1, each of the amplifiers has an offset voltage Vos.

Therefore, currents for each channel are determined as given in Equations below. It may be appreciated that all of the currents for each channel become different, such that matching characteristics are reduced.

$$I_{CH1} = \frac{ADIM - V_{OS1}}{R}$$

$$I_{CH2} = \frac{ADIM - V_{OS2}}{R}$$

$$I_{CH3} = \frac{ADIM - V_{OS3}}{R}$$

In order to improve the matching characteristics of the currents for each channel, a method of providing an additional compensation circuit or designing a multi-stage amplifier may be used. However, this method causes not only an increase in the entire chip size, but also causes an increase in a production cost of a chip.

SUMMARY OF THE INVENTION

An object of the present invention is to provide an LED driving device capable of improving matching characteristics of currents for each channel and miniaturizing an integrated circuit (IC) chip as compared to a case according to the related art.

According to an exemplary embodiment of the present invention, there is provided a light emitting diode (LED) driving device for driving a multi-channel LED element or an LED array, the LED driving device including: a constant current driver driving currents flowing in each channel; a first switching unit selectively feeding-back voltage levels of each channel to the constant current driver; and a switching controller controlling the turn on/off of the first switching unit.

The constant current driver may include: a driving amplifier including a non-inverting terminal to which a reference voltage is applied and an inverting terminal to which a voltage fed-back by the first switching unit is applied; a driving transistor including a control terminal connected to an output terminal of the driving amplifier and a first terminal connected to one end of the LED element or the LED array; and a driving resistor connected to a second terminal of the driving transistor and providing a feedback voltage level linearly corresponding to the current flowing in the LED element or the LED array.

The constant current driver may further include: a second switching unit connected between the output terminal of the driving amplifier and the control terminal of the driving transistor, and the switching controller may control the turn on/off of the first and second switching units.

The second switching unit may further have a pulse width modulation (PWM) control signal and/or an amplitude modulation (AM) control signal applied thereto.

The constant current driver may further include a buffer connected between the output terminal of the driving amplifier and the control terminal of the driving transistor and including a switch, the switch of the buffer may be controlled to be turned on/off by the switching controller, and the buffer may have a PWM control signal and/or an AM control signal applied thereto.

The switching controller may control the first and second switching units or the switch of the buffer by a clock (CLK) signal.

According to another exemplary embodiment of the present invention, there is provided a light emitting diode (LED) driving device for driving an LED device for each channel, the LED device including N LED channels each configured by connecting N LED arrays configured of at least one LED element in parallel, the LED driving device including: a driving amplifier including a non-inverting terminal having a reference voltage applied thereto; N driving transistors including a control terminal connected to an output terminal of the driving amplifier and a first terminal connected to one end of the LED array of each channel; N driving resistors connected to second terminals of each of the N driving transistors and providing feedback voltage levels linearly corresponding to the currents flowing in the LED array of each channel; N first switches having one end connected between the second terminal of each of the driving transistors and each of the driving resistors and the other end connected to an inverting terminal of the driving amplifier; and a switching controller controlling the N first switches so as to be sequentially turned on/off.

The LED driving device may further include N second switches connected between the output terminal of the driving amplifier and the control terminals of each of the driving transistors, and the switching controller may control the N first switches and the N second switches so as to be sequentially turned on/off.

The LED driving device may further include N buffers connected between the output terminal of the driving amplifier and the control terminals of each of the driving transistors and including switches, the switch of the buffer may be controlled to be turned on/off by the switching controller, and the buffer may have a PWM control signal and/or an AM control signal applied thereto.

The second switch may further have a PWM control signal and/or an AM control signal applied thereto.

The switching controller may control the first and second switches or the switch of the buffer by a clock (CLK) signal.

DESCRIPTION OF THE PREFERRED EMBODIMENTS

Figure 1:
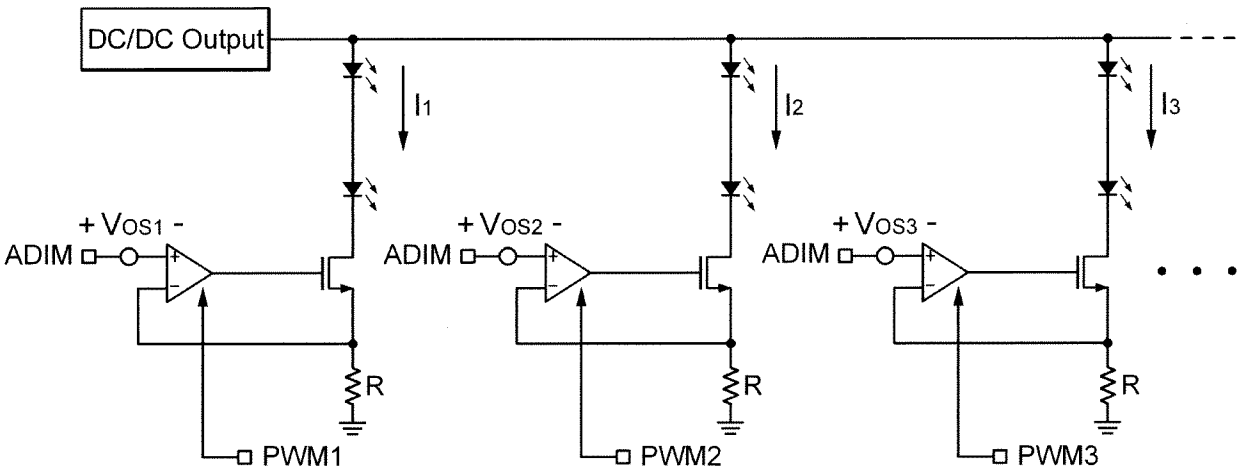
FIG. 1 is a circuit diagram showing a configuration of an LED driving device according to the related art.

Various advantages and features of the present invention and methods accomplishing thereof will become apparent from the following description of embodiments with reference to the accompanying drawings. However, the present invention may be modified in many different forms and it should not be limited to the embodiments set forth herein. These embodiments may be provided so that this disclosure will be thorough and complete, and will fully convey the scope of the invention to those skilled in the art. Like reference numerals throughout the description denote like elements.

Terms used in the present specification are for explaining the embodiments rather than limiting the present invention. Unless explicitly described to the contrary, a singular form includes a plural form in the present specification. The word "comprise" and variations such as "comprises" or "comprising," will be understood to imply the inclusion of stated constituents, steps, operations and/or elements but not the exclusion of any other constituents, steps, operations and/or elements.

Hereinafter, a configuration and operation of the present invention will be described in detail with reference to the accompanying drawings.

Figure 2:
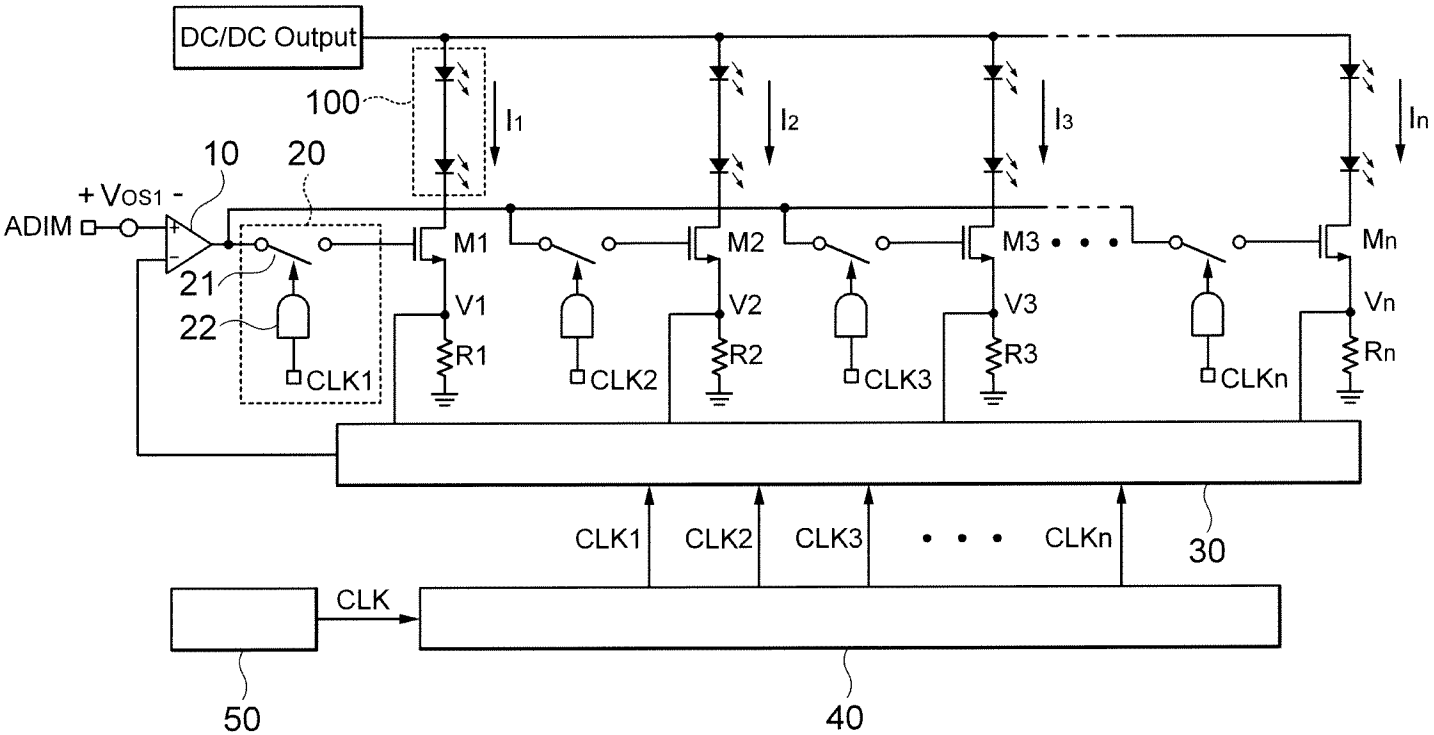
FIG. 2 is a circuit diagram showing a configuration according to an exemplary embodiment of the present invention.

FIG. 2 is a circuit diagram showing a configuration according to an exemplary embodiment of the present invention.

Referring to FIG. 2, an LED driving device according to an exemplary embodiment of the present invention may be configured to include a constant current driver, a first switching unit 30, and a switching controller.

A light emitting diode (LED) array 100 may be configured by connecting at least one LED elements in series. In addition, each of the channels may be configured by connecting a plurality of LED arrays 100 in parallel. Although not shown, the LED array 100 may also be configured of a single LED element, and a single channel may also be configured of a single LED element.

A configuration and an operating principle of the constant current driver are similar to those of the constant current driver according to the related art.

LED currents for each channel flowing in a string configuring the LED array 100 flow into a first terminal of a driving transistor M, and are maintained, are amplified or flow into a second terminal of the driving transistor M according to a signal applied to a control terminal of the driving transistor M.

The currents flowing from the second terminal of the driving transistor M form feedback voltage levels by driving resistors R, wherein the feedback voltage levels are connected to a driving amplifier 10 to thereby be compared with a reference voltage.

The driving amplifier 10 compares the feedback voltage levels with an applied reference voltage and amplifies a difference therebetween by a preset voltage gain to output the amplified voltage difference in a signal form at an output terminal thereof. The output terminal of the driving amplifier 10 is connected to the control terminal of the driving transistor M, thereby making it possible to maintain or increase the LED currents for each channel.

Here, the driving transistor M may be may be implemented as a junction transistor, a MOS transistor, or the like.

In the case in which a plurality of channels are provided, according to the related art, since amplifiers should be provided as many as the number of channels, as shown in FIG. 1, problems such as the difference in offsets for each amplifier as described above, etc., were caused. However, according to the present invention, the driving transistors M and the driving resistors R are provided for each channel, all of the control terminals of the driving transistors M are connected to an output terminal of a single driving amplifier 10, and the first switching unit 30 is provided so that the feedback voltage levels of all channels may be selected one by one and input to an inverting terminal of the driving amplifier 10, as shown in FIG. 2, thereby making it possible to solve the matching characteristics of the currents for each channel due to the offset of the amplifier, which was the problem according to the related art, without providing an additional compensation circuit.

The first switching unit 30 may be implemented by a general clock switch, and the switching controller controlling the switching of the first switching unit 30 may be implemented by a general clock signal generator 50 and a phase shifter 40.

That is, when a clock1 (CLK1) signal is applied from the phase shifter 40 to the first switching unit 30, a feedback voltage level of channel1 is applied to the inverting terminal of the driving amplifier 10, when a clock2 (CLK2) signal is applied from the phase shifter 40 to the first switching unit 30, a feedback voltage level of channel2 is applied to the inverting terminal of the driving amplifier 10, and when a clockn (CLKn) signal is applied from the phase shifter 40 to the first switching unit 30, a feedback voltage level of channeln is applied to the inverting terminal of the driving amplifier 10.

The LED currents of all channels may be driven at a predetermined level by the single driving amplifier 10 through the above-mentioned configuration.

Meanwhile, the output terminal of the driving amplifier 10 and the control terminals of the driving transistors M1, M2, M3, Mn for each channel may further include second switching units 20 provided therebetween.

Here, the second switching unit 20 may be configured to include a second switch 21 and a switching control signal inputting unit 22.

The second switching unit 20 is controlled to be turned on/off together with the first switching unit 30, thereby making it possible to allow a signal value output from the driving amplifier 10 by the feedback voltage level for a specific channel to be reflected only in the channel.

The second switching unit 20 may be controlled to be turned on/off by the switching controller 40 and 50, similar to the first switching unit 30. A separate switching controller may also be provided. However, as components increase, the entire size of the LED driving device increases, such that a cost of the LED driving device increases. Therefore, it is not preferable that the separate switching controller is provided.

In addition, when the switching controller is configured to control both of the first switching unit 30 and the second switching unit 20, turn on/off operations of the first switching unit 30 and the second switching unit 20 may be easily synchronized with each other.

Figure 3:
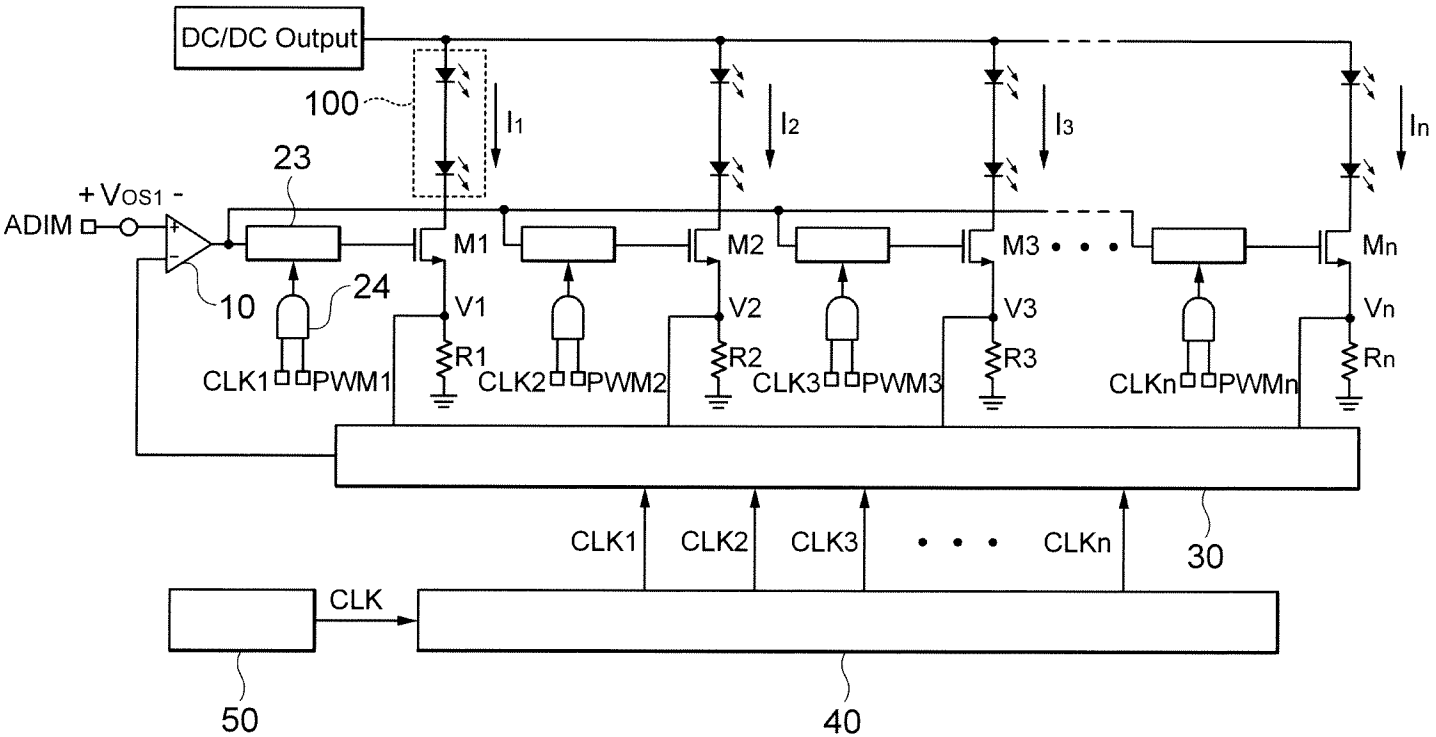
FIG. 3 is a circuit diagram showing a configuration according to another exemplary embodiment of the present invention.

FIG. 3 is a circuit diagram showing a configuration according to another exemplary embodiment of the present invention. FIG. 3 shows a case in which buffers 23 including a switch may be provided instead of the second switching units 20 shown in FIG. 2.

In the case of the configuration shown in FIG. 3, the buffers 23 including the switch receives additional control signals such as pulse width modulation (PWM) control signals, amplitude modulation (AM) control signals, or the like, through a control signal inputting unit 24, while connecting the output terminal of the driving amplifier 10 to each of the driving transistors M according to a clockn (CLKn) signal, to apply the additional control signals to the driving transistor M of the corresponding channel, thereby making it possible to implement an additional detailed operation such as dimming or scanning operations for each channel, etc.

Meanwhile, when the additional control signals such as the PWM control signals, the AM control signals, or the like, are applied as described above, excessive signals are instantaneously applied, such that the LED currents for each channel are rapidly changed, thereby making it possible to cause damage of an element. Therefore, the buffer 23 capable of mitigating the excessive signal is preferably provided. Buffers 23 having various configurations that have already been widely used may be used as the buffer 23. Accordingly, a detailed description thereof will be omitted.

Figure 4:
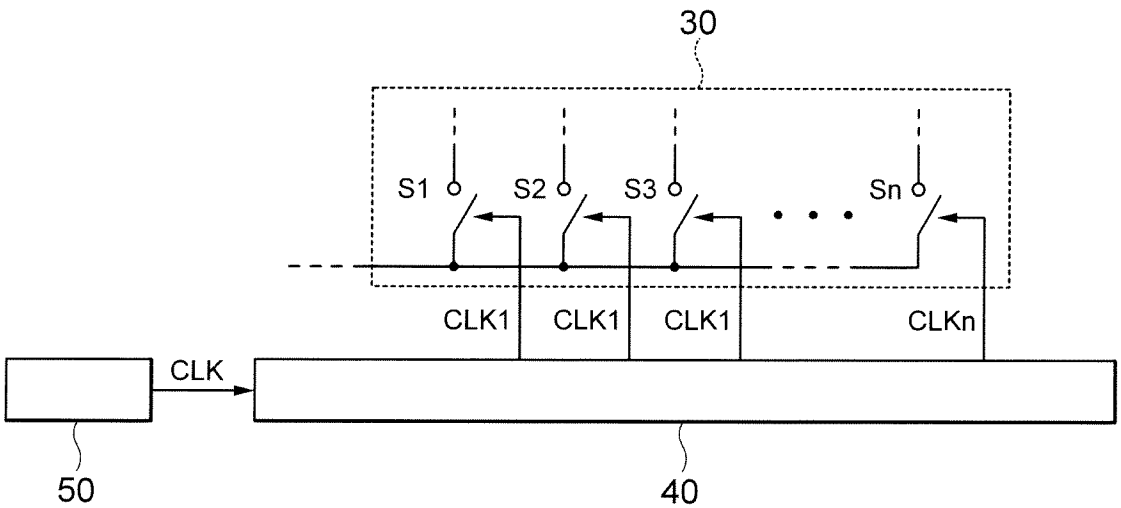
FIG. 4 is an enlarged view showing main parts according to an exemplary embodiment of the present invention.

FIG. 4 shows an example of a configuration of the first switching unit 30.

As shown in FIG. 4, the first switching units 30 includes switches S1, S2, S3, . . . Sn provided as many as the number of channels and connected between the resistor and the second terminal of the driving transistor M for each channel. The switches S1, S2, S3, . . . Sn are sequentially turned on and then turned off according to the clock signal of the switching controller 40 and 50, thereby making it possible to allow the current of the corresponding channel to be maintained in a predetermined range.

Meanwhile, although the accompanying drawings show a case in which a single driving amplifier 10 is provided, in the case in which the number of channels increases, the channels may be divided into two or more groups and be controlled by the constant current driver including the amplifiers for each of the divided groups.

With the present invention configured as described above, a plurality of channels are driven at a constant current by a single amplifier, thereby making it possible to solve the problems that a separate compensation circuit for compensating for a difference in offsets for each channel should be provided in the multi-channel LED driving device according to the related art.

In addition, the number of amplifiers for constant current driving of each channel is reduced to improve matching characteristics of currents flowing in each channel, thereby making it possible to solve a performance deterioration problem due to degradation of the matching of the currents between the channels.

Further, the number of amplifiers is reduced and the separate compensation circuit is not required, such that a size of an integrated circuit (IC) chip is also reduced as compared to a case according to the related art, thereby making it possible to satisfy the trend of miniaturization of the chip.

The present invention has been described in connection with what is presently considered to be practical exemplary embodiments. Although the exemplary embodiments of the present invention have been described, the present invention may be also used in various other combinations, modifications and environments. In other words, the present invention may be changed or modified within the range of concept of the invention disclosed in the specification, the range equivalent to the disclosure and/or the range of the technology or knowledge in the field to which the present invention pertains. The exemplary embodiments described above have been provided to explain the best state in carrying out the present invention. Therefore, they may be carried out in other states known to the field to which the present invention pertains in using other inventions such as the present invention and also be modified in various forms required in specific application fields and usages of the invention. Therefore, it is to be understood that the invention is not limited to the disclosed embodiments. It is to be understood that other embodiments are also included within the spirit and scope of the appended claims.

What is claimed is:

1. A light emitting diode (LED) driving device for driving a multi-channel LED element or an LED array, the LED driving device comprising:

a constant current driver driving currents flowing in each channel;

a first switching unit selectively feeding-back voltage levels of each channel to the constant current driver; and a switching controller controlling the turn on/off of the first switching unit.

2. The LED driving device according to claim 1, wherein the constant current driver includes:

a driving amplifier including a non-inverting terminal to which a reference voltage is applied and an inverting terminal to which a voltage fed-back by the first switching unit is applied;

a driving transistor including a control terminal connected to an output terminal of the driving amplifier and a first terminal connected to one end of the LED element or the LED array; and a driving resistor connected to a second terminal of the driving transistor and providing a feedback voltage level linearly corresponding to the current flowing in the LED element or the LED array.

3. The LED driving device according to claim 2, wherein the constant current driver further includes: a second switching unit connected between the output terminal of the driving amplifier and the control terminal of the driving transistor, and the switching controller controls the turn on/off of the first and second switching units.

4. The LED driving device according to claim 3, wherein the second switching unit further has a PWM control signal and/or an AM control signal applied thereto.

5. The LED driving device according to any one of claims 1 to 4, wherein the switching controller controls the first and second switching units or the switch of the buffer by a clock (CLK) signal.

6. The LED driving device according to claim 2, wherein the constant current driver further includes a buffer connected between the output terminal of the driving amplifier and the control terminal of the driving transistor and including a switch, the switch of the buffer is controlled to be turned on/off by the switching controller, and the buffer has a pulse width modulation (PWM) control signal and/or an amplitude modulation (AM) control signal applied thereto.

7. A light emitting diode (LED) driving device for driving an LED device for each channel, the LED device including N LED channels each configured by connecting N LED arrays configured of at least one LED element in parallel, the LED driving device comprising:

a driving amplifier including a non-inverting terminal having a reference voltage applied thereto;

N driving transistors including a control terminal connected to an output terminal of the driving amplifier and a first terminal connected to one end of the LED array of each channel;

N driving resistors connected to second terminals of each of the N driving transistors and providing feedback voltage levels linearly corresponding to the currents flowing in the LED array of each channel;

N first switches having one end connected between the second terminal of each of the driving transistors and each of the driving resistors and the other end connected to an inverting terminal of the driving amplifier; and a switching controller controlling the N first switches so as to be sequentially turned on/off.

8. The LED driving device according to claim 7, further comprising N second switches connected between the output terminal of the driving amplifier and the control terminals of each of the driving transistors, wherein the switching controller controls the N first switches and the N second switches so as to be sequentially turned on/off.

9. The LED driving device according to claim 8, wherein the second switch further has a PWM control signal and/or an AM control signal applied thereto.

10. The LED driving device according to any one of claims 7 to 9, wherein the switching controller controls the first and second switches or the switch of the buffer by a clock (CLK) signal.

11. The LED driving device according to claim 7, further comprising N buffers connected between the output terminal of the driving amplifier and the control terminals of each of the driving transistors and including switches, wherein the switch of the buffer is controlled to be turned on/off by the switching controller, and the buffer has a PWM control signal and/or an AM control signal applied thereto.

* * * * *